US006834855B2

(12) United States Patent
Mancuso

(10) Patent No.: US 6,834,855 B2
(45) Date of Patent: Dec. 28, 2004

(54) DICE SCANNER

(76) Inventor: Edward J. Mancuso, 1384 Dragon Rock Dr., Henderson, NV (US) 89052

( * ) Notice: Subject to any disclaimer, the term of this patent is extended or adjusted under 35 U.S.C. 154(b) by 340 days.

(21) Appl. No.: 09/972,658

(22) Filed: Oct. 9, 2001

(65) Prior Publication Data

US 2003/0067110 A1 Apr. 10, 2003

(51) Int. Cl.[7] ..... A63F 9/04
(52) U.S. Cl. ..... 273/146; 273/138.3
(58) Field of Search ..... 273/146, 138.2

(56) References Cited

U.S. PATENT DOCUMENTS 4,007,377 A * 2/1977 Simon et al. ..... 235/462.38
4,707,251 A * 11/1987 Jenkins et al. ..... 198/416
4,717,026 A * 1/1988 Fischer et al. ..... 194/205
4,833,308 A * 5/1989 Humble ..... 235/383
5,085,517 A * 2/1992 Chadwick et al. ..... 356/394
5,131,755 A * 7/1992 Chadwick et al. ..... 356/394
5,150,900 A * 9/1992 Onzo ..... 273/146
5,311,969 A * 5/1994 Dickover et al. ..... 186/61
5,401,947 A * 3/1995 Poland ..... 235/383
5,415,413 A * 5/1995 Morinich ..... 273/146
5,691,684 A * 11/1997 Murrah ..... 235/385
5,709,139 A * 1/1998 Shimizu et al. ..... 83/54
5,909,874 A * 6/1999 Daniel et al. ..... 273/146
6,032,861 A * 3/2000 Lemelson et al. ..... 235/456
6,105,004 A * 8/2000 Halperin et al. ..... 235/383
6,122,403 A * 9/2000 Rhoads ..... 382/233
6,219,503 B1 * 4/2001 Miyake et al. ..... 399/85
6,223,163 B1 * 4/2001 Van Luchene ..... 705/1
6,236,974 B1 * 5/2001 Kolawa et al. ..... 705/7
6,257,580 B1 * 7/2001 Brown ..... 273/146
6,275,200 B1 * 8/2001 Heady et al. ..... 345/418
6,316,284 B1 * 11/2001 Perregaux et al. ..... 438/70
6,330,543 B1 * 12/2001 Kepecs ..... 705/14
6,331,145 B1 * 12/2001 Sity et al. ..... 273/138.2

* cited by examiner

*Primary Examiner*—Derris H. Banks
*Assistant Examiner*—Dolores R. Collins
(74) *Attorney, Agent, or Firm*—Leonard Weiss

(57) ABSTRACT

A coded representation of a verification number is printed in a bar code strip. The strip is embedded in a face of a die. The face is scanned by a scanner that is programmed to provide an indication that the coded representation is printed on the strip.

5 Claims, 3 Drawing Sheets

DICE SCANNER

BACKGROUND OF THE INVENTION

1. Field of Invention

This invention is in the general field of casino gaming and, more particularly, is an apparatus that reduces a probability of cheating and increases rolls of dice per unit time in a crap game.

2. Description of the Prior Art

During a crap game in a casino, a die typically rolls off a dice table and onto a floor about ten times per hour. Prior to putting the die back into play, it is examined by a casino employee to verify that a highly visible identification number is on one face and a barely visible security marking is on another face.

It takes approximately thirty seconds to recover the die, check the identification number, check the security marking and put the die back in play. Therefore, during a single day approximately two hours of playing time is lost. The loss of the playing time results in a loss of revenue for the casino. Therefore, it is desirable to reduce the loss of the playing time as much as possible.

An undesirable aspect of the identification number and the security marking is that they are noticeable to anyone who handles the die. Therefore, the identification number and the security number can be used by a person to produce dice that could be surreptitiously introduced into the crap game. When the surreptitiously introduced dice have a weight imbalance, a user has a decisive advantage. In other words, the identification number and the security marking do not adequately prevent cheating in the crap game.

For reasons given hereinbefore, there is a need for providing a rapid means for putting the die back into play when it rolls of the table and for preventing cheating.

SUMMARY OF THE INVENTION

An object of the invention is to rapidly verify that a die used in a dice game has not been surreptitiously replaced.

According to one aspect of the present invention, a bar code strip with a printed coded representation of a verification character is connected to a face of a die. A scanner is operable to scan the face to verify the presence of the printed coded representation.

According to another aspect of the present invention, prior to shipment to a casino, the die is wrapped within a wrapper that has an inside surface with a numeric representation of the bar code thereon. When the wrapped die is received by the casino, a designated casino employee unwraps the die and enters the numeric representation into the scanner thereby enabling the use of the scanner to verify the presence of the bar code.

The invention increases time that a die is in play and reduces the probability of cheating in a dice game.

Other objects, features and advantages of the invention should be apparent from the following description of the preferred embodiment as illustrated in the accompanying drawing.

DESCRIPTION OF THE PREFERRED EMBODIMENT

Figure 1:
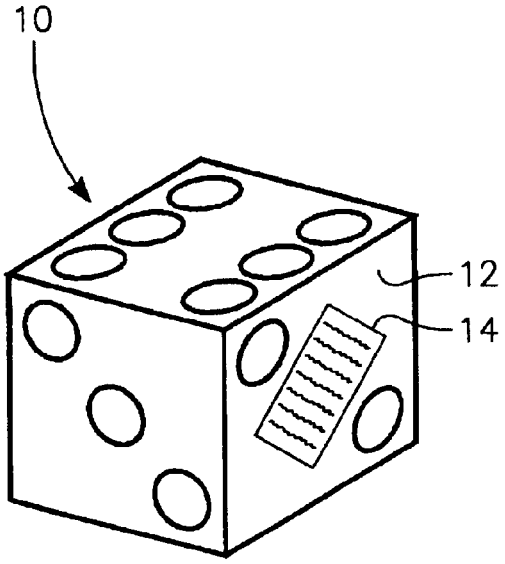
FIG. 1 is a perspective view of bar code strip embedded within a translucent die.

As shown in FIG. 1, a bar code strip 14 has a coded representation of a verification number, 875, printed thereon. The strip 14 is embedded in a face 12 of a translucent die 10. As explained hereinafter, when the face 12 is scanned by a suitably programmed bar code scanner, an indication is provided by the scanned by a suitably programmed bar code scanner, an indication is provided by the scanner that the coded representation of the verification number is printed on the strip 14.

Figure 2:
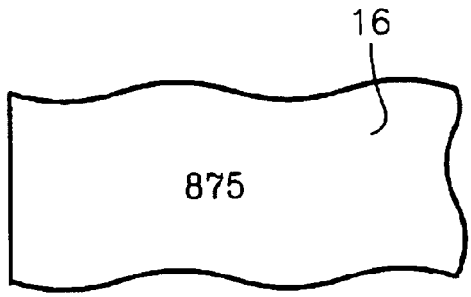
FIG. 2 is a plan view of a dice wrapper.

As shown in FIG. 2, a wrapper 16 has an interior surface 18 with the verification number printed thereon. A manufacturer of the die 10 (FIG. 1) seals it in the wrapper 16 with only an outer surface (not shown) of the wrapper 16 exposed to view. The die 10, sealed in the wrapper 16, is shipped to a casino. Because only the outer surface is exposed to view, the verification number remains unknown at the casino until the die 10 is unwrapped. Preferably, a pit boss of the casino unwraps the die 10.

Figure 3:
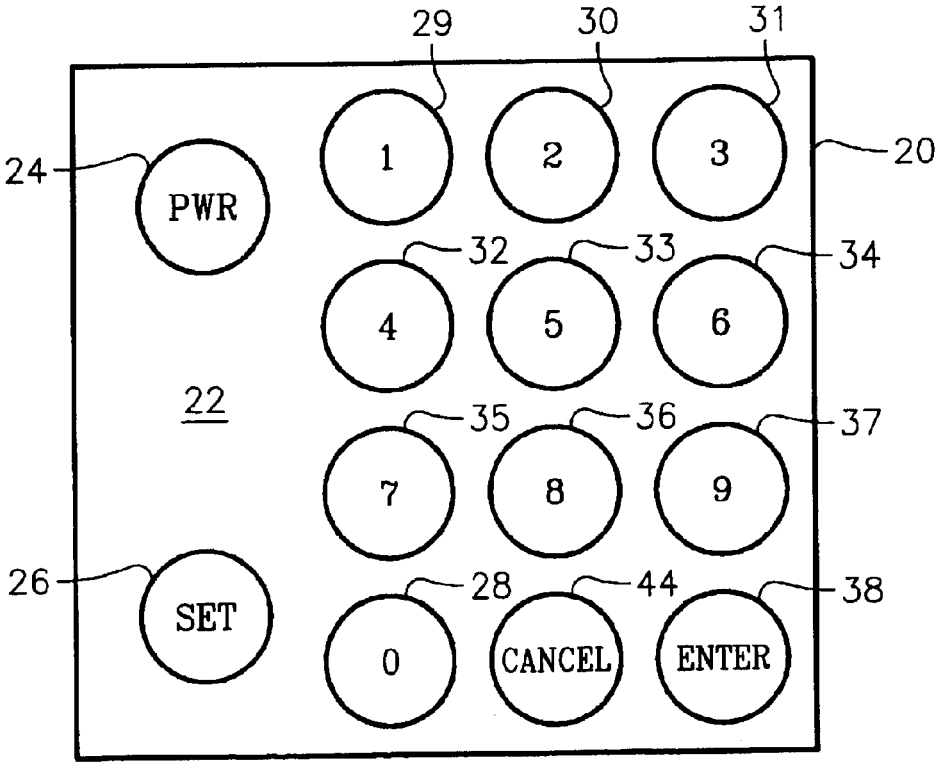
FIG. 3 is a plan view of the front of a scanner.

As shown in FIG. 3, a scanner 20 has a front surface 22 with a pushbutton 24 extending therefrom. An imprint of the letters, PWR, is carried on the pushbutton 24. When the scanner 20 is to be programmed, the pushbutton 24 is depressed to cause an application of electrical power to circuit elements within the scanner 20.

An imprint of the letters, SET, is carried on a pushbutton 26 that extends from the surface 22. When the power is applied, the set button 26 is depressed to enable programming of the scanner 20.

Numeric pushbuttons 28–37 that extend from the surface 22 carry imprints of the numbers zero through nine, respectively. Additionally, a pushbutton 39 that carries an imprint of the word, ENTER, extends from the surface 22.

When the scanner 20 is to be programmed to verify that the strip 14 has the coded representation of the number, 875, the pushbuttons 36, 35, 33, 39 are depressed in succession with the pushbutton 36 being depressed first.

A pushbutton 44 that extends from the surface 22 carries an imprint of the word, CANCEL. When an incorrect one of the pushbuttons 29–37, 39 is inadvertently depressed, the pushbutton 44 is depressed and programming of the scanner 20 is repeated as described hereinbefore.

Figure 4:
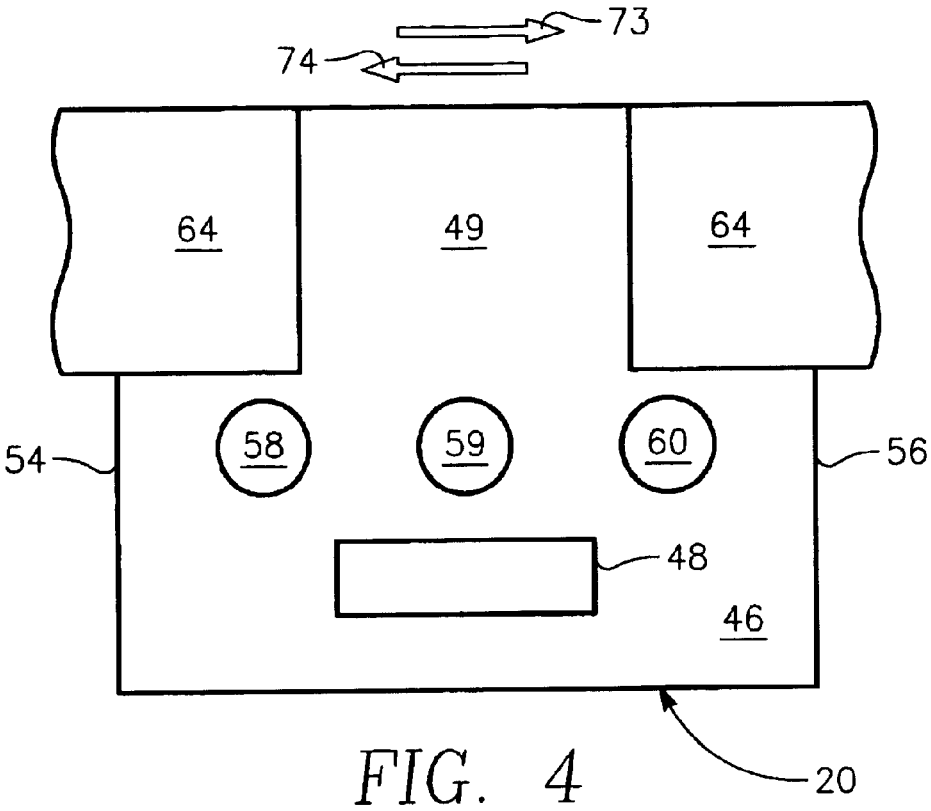
FIG. 4 is a plan view of the top of the scanner of FIG. 3.

As shown in FIG. 4, the scanner 20 has a top panel 46 with an optical input window 48. An arm 49 is integrally connected to the panel 46. When the scanner 20 verifies the die 10, the face 12 is placed proximal to the window 48 whereby the face 12 is scanned.

Holes 50, 51, 52 through the panel 46 are evenly spaced between panel edges 54, 56. The holes 50, 51, 52 provide a view of indicator lamps 58, 59, 60, respectively. The lamp 58 is illuminated when electrical power is applied to the scanner 20. The lamp 51 is illuminated during verification of the die 10. The lamp 60 is illuminated when the coded representation of the verification number is on the strip 14 during verification of the die 10.

Figure 5:
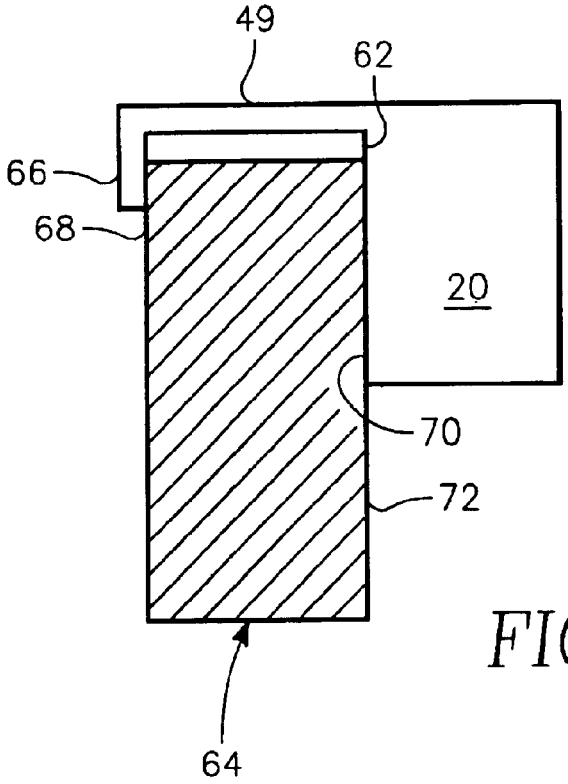
FIG. 5 is a side elevation of the scanner of FIG. 3.

As shown in FIG. 5, a rubber pad 62 is fixedly connected atop a side rail 64 of a dice table. The arm 49 rests upon the pad 62.

The arm 49 is integrally connected to a right angle extension 66 that is in contact with a side 72 of the rail 64.

The scanner 20 is slidable along the rail 64 in directions indicated by arrows 73, 74 (FIG. 4) whereby the scanner 20 is slidably mounted. The slidable mounting of the scanner 20 is maintained because the extension 66 and surface 70 are in contact with the sides 68, 72, respectively.

Figure 6:
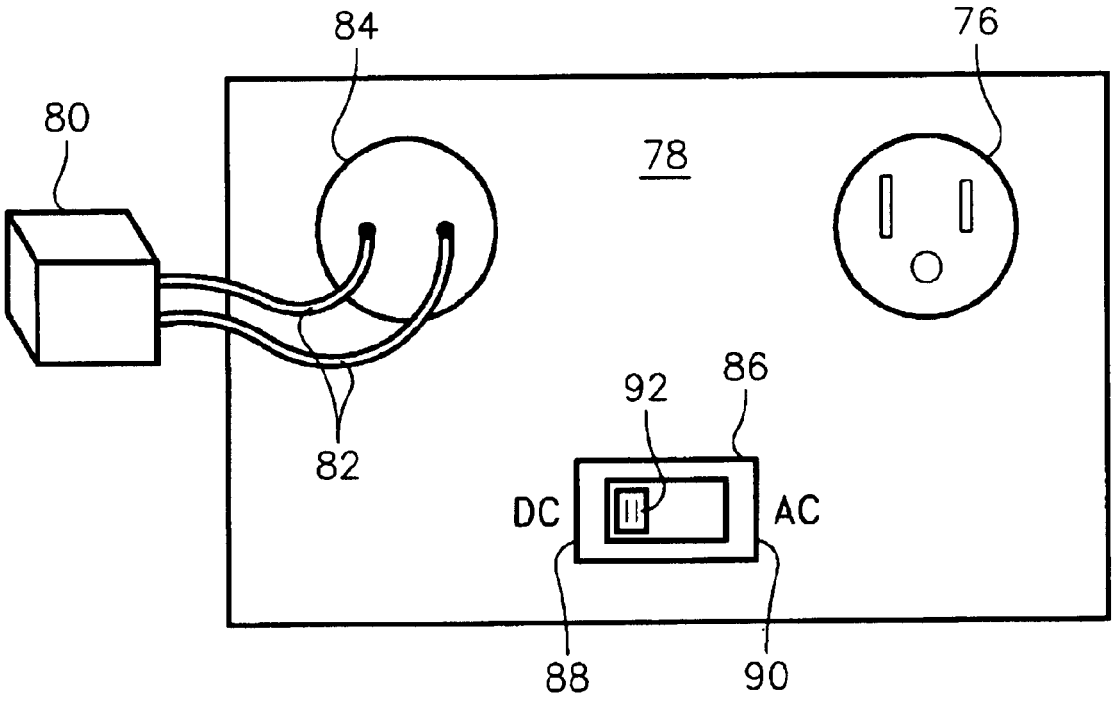
FIG. 6 is a bottom view of the scanner of FIG. 3.

As shown in FIG. 6, a power receptacle 76 extends through a bottom panel 78 of the scanner 20. The receptacle 78 is adapted for connection to a 115 volt, 60 cycle AC power source. Additionally, a direct current receptacle 80 is connected through wires 82 to a fixture 84 that extends through the panel 84. The receptacle 80 is adapted for connection to a direct current power source.

A power selection switch 86 extends through the panel 78. The panel 78 carries a printing of the letters, DC, proximal to a side 88 of the switch 86. Correspondingly, the panel 78 carries a printing of the letters, AC, proximal to a side 90 of the switch 86.

The switch 86 has a plastic lever 92 that is thrown towards the side 90 when the receptacle 76 is connected to the AC power source and a decision is made to use the AC power source to provide electrical power to the scanner 20. Correspondingly, the lever 92 is thrown towards the side 88 when the receptacle 80 is connected to the direct current power source and a decision is to use the direct current power source to provide electrical power to the scanner 20.

While the invention has been particularly shown and described with reference to a preferred embodiment, it should be understood by those skilled in the art that changes in form and detail may be made therein without departing from the spirit and scope of the invention.

I claim:

1. Apparatus for verifying an identification of a die, comprising:

a bar code strip with a coded representation of a verification character printed thereon, said strip being connected to a face of the die; and a bar code scanner that is programmed to provide on indication that said coded representation is printed on said strip in response to said face being scanned by said scanner.

2. The apparatus of claim 1 additionally comprising a lamp included in said scanner, said indication being an illumination of said lamp.

3. The apparatus of claim 1, additionally including means for slidably mounting said scanner on a side rail of a dice table.

4. In the method of providing a translucent die with a verifiable identity to a casino, comprising the steps of:

manufacturing the die with a face connected to a bar code strip, a coded representation of a verification character being printed on said strip;

providing a wrapper with the verification character printed on its interior surface;

sealing the die in said wrapper so that only an outer surface of said wrapper is exposed to view;

shipping the sealed die to the casino;

unwrapping the die whereby the verification character becomes known in the casino; and providing a scanner that is programmed to indicate that the coded representation is printed on the strip when the face is scanned by said scanner.

5. A gaming device for a casino, comprising:

a die; and a bar code strip whereon a coded representation of a verification character is printed, said strip being connected to a face of said die.

* * * * *